United States Patent [19]

Johnston

[11] 4,279,525

[45] Jul. 21, 1981

[54] CALCULATOR PRINTER HAVING AN ACOUSTIC NOISE SUPPRESSOR

[75] Inventor: John N. Johnston, North Plainfield, N.J.

[73] Assignee: Litton Business Systems, Inc., Morris Plains, N.J.

[21] Appl. No.: 99,520

[22] Filed: Dec. 3, 1979

[51] Int. Cl.[3] ..... B41J 11/08; B41J 11/13

[52] U.S. Cl. ..... 400/656; 400/661; 400/124

[58] Field of Search ..... 400/124, 656, 689, 661.1, 400/661; 181/198, 201, 205

[56] References Cited

U.S. PATENT DOCUMENTS

| | | | |
|---|---|---|---|
| 2,059,275 | 11/1936 | Pitman | 400/689 |
| 2,104,482 | 1/1938 | Helmond | 400/661.1 |
| 4,062,436 | 12/1977 | Kondur et al. | 400/124 |

*Primary Examiner*—Paul T. Sewell

*Attorney, Agent, or Firm*—Michael H. Wallach; Robert F. Rotella

[57] ABSTRACT

An acoustical noise attenuating platen for an impact printer including lead material fastened with a thermoplastic compound to the rear surface of a non-rotatable bar.

5 Claims, 5 Drawing Figures

CALCULATOR PRINTER HAVING AN ACOUSTIC NOISE SUPPRESSOR

BACKGROUND OF THE INVENTION

1. Field of the Invention

This invention relates to impact printers capable of printing a record on a paper medium.

2. Description of the Prior Art

Calculators and other machines requiring the printing of a record on a paper medium are known in the prior art which include various arrangements of acoustical noise suppression material for reducing unwanted noise which is mechanically generated during the printing process. For example, some calculators have included therein arrangements of foam or rubber to isolate the printer mechanism from the case of the calculator in an effort to reduce the transmission and reradiation of noise therefrom. Still other calculators are known in which the platen of the printer mechanism includes a plurality of discrete segmented strips of lead which absorb noise produced by the impact of print elements against the platen.

One problem with some prior known acoustic noise suppressors for printer mechanisms is that they are not sufficiently close to the point of impact of the print elements against the platen to suppress the noise radiating therefrom.

Another problem is that prior known printers having lead or other acoustical insulation placed at discrete locations along the length of the platen may not uniformly attenuate noise produced at locations on the platen intermediate the locations containing the lead or other insulating material.

Still another problem is that some prior known printers which are located in an exposed location on a calculator or other machine cannot effectively be made to attenuate noise produced by the impact of print elements against the platen by surrounding the printer with noise-absorbing foam.

SUMMARY OF THE INVENTION

One object of this invention to provide an acoustic noise suppressor which is located close to the source of noise produced in a printing mechanism by the impact of the print elements against the platen.

Another object is to provide an acoustic noise suppressor which is effective in uniformly suppressing noise produced along the entire length of the printer platen.

Still another object is to provide an acoustic noise suppressor which is effective in suppressing noise produced by the impact of print elements against the platen of a printer mechanism which is located in an exposed location on a calculator or other machine.

The above and other objects and advantages are achieved by forming a strip of acoustical absorbent material into a shaped segment whose shape is complemental to the shape of the paper supporting platen of the printer mechanism. The acoustical absorbent material is fastened to the rear of the platen, behind the surface struck by the print elements during the process of printing an image on a paper medium. Noise which is generated by the impact of the print elements against the platen is absorbed by the acoustical absorbent material and is thereby prevented from being re-radiated and disturbing the machine operator.

BRIEF DESCRIPTION OF THE DRAWING

The above and other objects of this invention will become evident from an understanding of the preferred embodiment which is set forth in such detail to enable those skilled in the art to readily understand the function, operation, construction and advantages of it when read in conjunction with the accompanying drawings in which.

DESCRIPTION OF THE PREFERRED EMBODIMENT

Figure 1:
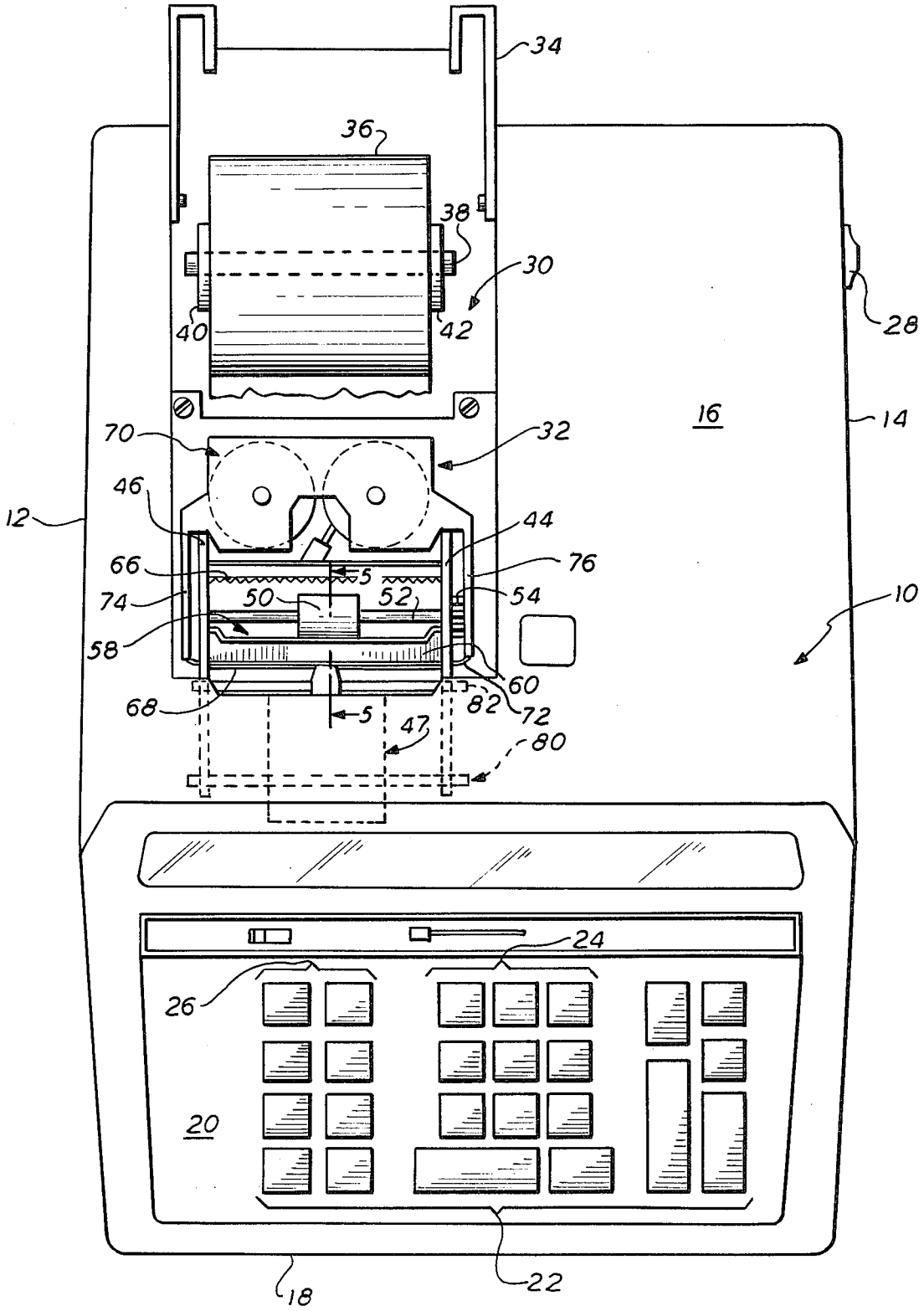
FIG. 1 is a top plan view of a calculator having a printer mechanism incorporating the teachings of this invention applied thereto.
Figure 2:
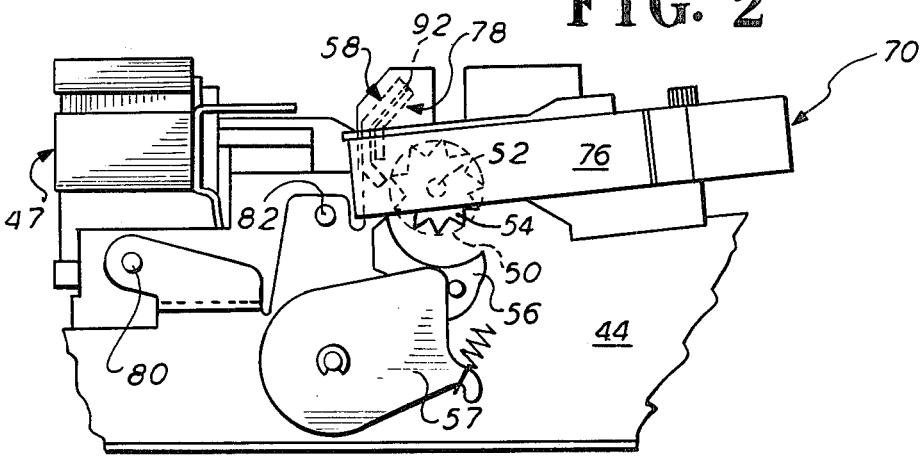
FIG. 2 is a side view of the printer mechanism shown in FIG. 1.

Referring to the drawings, FIG. 1 shows a machine having a printer mechanism with the teachings of this invention applied thereto. For purposes of illustration the printer mechanism is shown incorporated into a calculator. The calculator preferably includes a case 10 having a pair of substantially parallel sidewalls 12 and 14 and a top cover 16 extending between the sidewalls 12 and 14. A front wall 18 also extends between the sidewalls 12 and 14 and, together with the sidewalls 12 and 14 supports a sloping panel 20. The sloping panel 20 contains a keyboard 22 having a plurality of keys contained thereon. Preferably the keys of the keyboard 22 are divided into two or more sets, which include a set for the entry of numeric information 24 and a set which includes keys for implementing a plurality of mathematical operations 26, such as the processes of addition, substraction, multiplication and division. The panel 20 may also contain other switches. A switch 28 is shown on the sidewall 14 for controlling the application of electrical power to the calculator.

It will be appreciated by those skilled in the art of computing mathematical results with a calculator machine that it is advantageous to have a printed record of the mathematical indicia which form a problem and the results of the mathematical computation performed by the calculator. To satisfy the desire for such a record, the calculator which is shown for illustrative purposes in FIG. 1 includes a compartment 30 located beneath the top cover 16 which houses a printer mechanism shown generally at 32. The top cover 16 includes an access lid 34 hingedly fastened thereto by an suitable means, which permits an operator to gain access to the printer mechanism 32 by rotating the lid 34 upwardly away from the cover 16.

FIG. 1 illustrates that the printer mechanism 32 includes a supply of printing paper such as that shown on the spool 36. The spool 36 is axially supported on a roller 38 to permit paper to be withdrawn therefrom during the operation of the printer 32. The roller 38 is supported between a pair of frames 40 and 42 which are fastened within the compartment 30. The printer mechanism 32 includes a pair of substantially vertical sidewalls 44 and 46. Preferably the sidewall 44 is constructed parallel to the sidewall 46 to permit the support therebetween of component elements of the printer mechanism.

The printer mechanism 32 has a means for moving the printer paper in a path from the printer paper supply past a printing means shown as a print head 47 which contains a set of print elements 48 which are selectively operable to impart an image on the printer paper. The paper moving means includes a frictional paper feeding roller 50 which is preferably formed of a rubber compound and which is mounted on a roller shaft 52 which is rotatably supported between the side wall 44 and the sidewall 46. A paper feeding ratchet wheel 54 is rigidly fastened to the roller shaft 52 external to the sidewall 44. The roller 50 is selectively rotated to frictionally move the paper from the supply spool 36 toward the print elements 48 by periodically engaging a pivotally mounted pawl 56 carried by a crank 57 against the ratchet wheel 54 to cause the wheel 54 to rotate in a manner which need not be fully set forth herein for a full understanding of the present invention.

A platen 58 is fastened between the sidewall 44 and the sidewall 46 and includes a front surface 60 which is contacted by the printer paper as the paper is moved past the print elements 48 and a rear surface 62 which faces away from the front surface 60. Preferably the platen 58 includes an upper portion 64 which slopes upward and away from the path taken by the printer head 47 in moving across the paper and which acts to deflect the printer paper toward a paper cutter lever 66 which is supported above the platen 58 by the sidewalls 44 and 46. A paper guide 68, which is preferably formed from a flexible material such as a spring steel is fastened between the sidewalls 44 and 46 so that it overlies a portion of the front surface 60 of the platen 58 and exerts pressure against the printer paper to retain the paper against the front surface 60 of the platen 58 as the roller 50 moves the paper along a path from the supply spool 36 toward the print elements 48.

Preferably the printer mechanism includes a ribbon supply which is shown in FIG. 1 as the ribbon cartridge 70 which contains a supply of inked ribbon 72. The ribbon 72 is guided by a pair of outwardly extending arms 74 and 76 from the cartridge 70 toward the location where the print elements 48 move against the printer paper, so that the ribbon is interposed between the print elements 48 and the paper.

Figure 4:
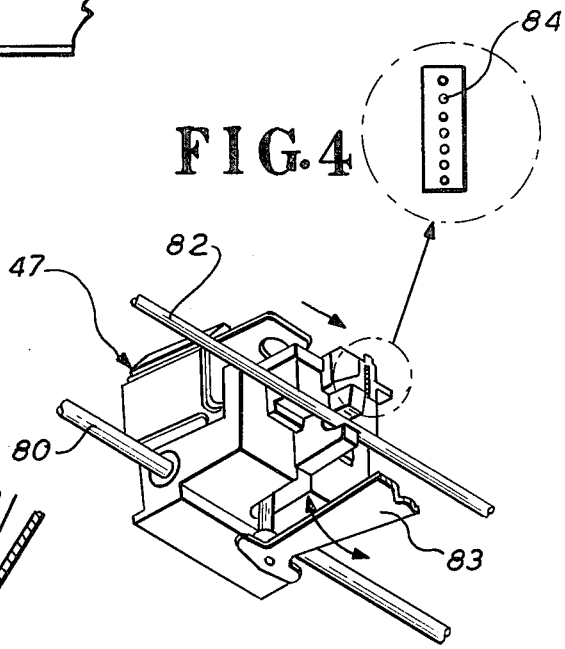
FIG. 4 is a perspective view of the printer head.
Figure 3:
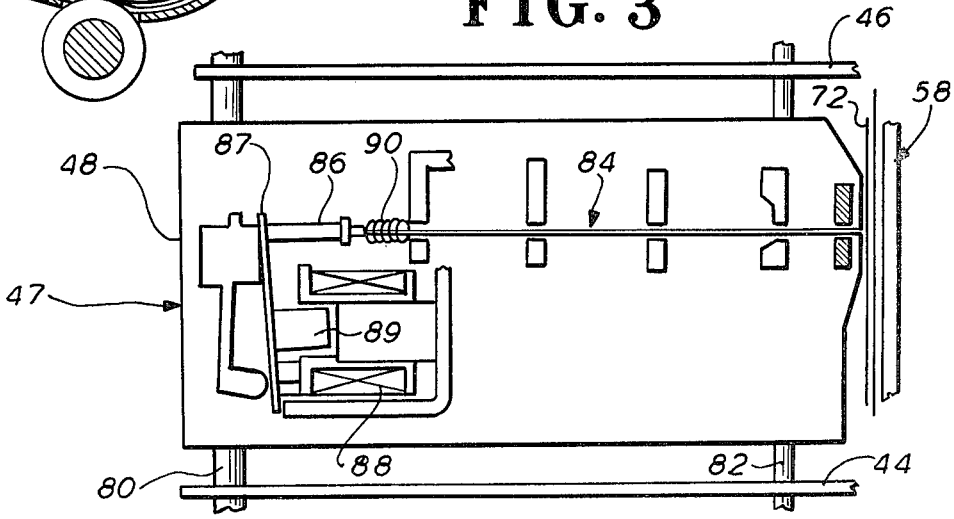
FIG. 3 shows a portion of the printer mechanism including one print element and the platen which supports the printer paper.

The printing means includes the set of print elements 48, one of which is shown in FIG. 3, which are contained within the printer head 47. FIG. 4 illustrates that a means for moving the print head 47 across the width of the printer paper includes a first guide bar 80 and a second guide bar 82 each of which is spaced apart from but whose longitudinal axes are parallel to the platen 58, and an arcuately movable link 83 having one extremity pivotally fastened to the printer head 47. The printer head 47 is driven along the longitudinal axes of the guide bars 80 and 82 so that the elements 48 of the head 47 may be positioned at any location along the width of the printer paper to permit a character to be printed thereon. The opposite extremity of the link 83 is arcuately slewed by a drive mechanism whose construction need not be understood for a complete understanding of the present invention. FIG. 4 also illustrates that the printer head 47 is preferably comprised of seven print elements 48 one of which is shown in FIG. 3 and each of which includes a dot wire 84 formed with an actuating extremity 86 and an electromagnet or solenoid 88 arranged to drive the dot wire 84 toward the printer paper by drawing a lever 87 having an anvil 89 fastened thereto against the actuating extremity 86 when a source of electricity is connected to one of the electromagnets 88. Preferably the dot wires 84 are vertically spaced one above the other. Each wire 84 has associated therewith a return spring 90 which is carried about the wire 84 and which acts to move the dot wire 84 away from the printer paper when the electromagnet 88 is deenergized.

Characters are formed on the printer paper by moving the printer head 47 longitudinally along the guide bars 80 and 82 and selectively energizing the appropriate print elements 48 so that one or more of the vertically spaced dot wires 84 strike the ribbon 72 and cause a column having one or more dots to be printed on the paper. It will be appreciated by those skilled in the art of printer construction that any type of character may be formed by controlling the location at which the print elements 48 are energized and, therefore, a line of many characters will require energizing the printer elements 48 at frequent intervals across the width of the printer paper. Since each character printed may require several columns of dots, it is apparent that a considerable quantity of noise may be generated by the operation of the printer mechanism during a long or complex calculation.

Figure 5:
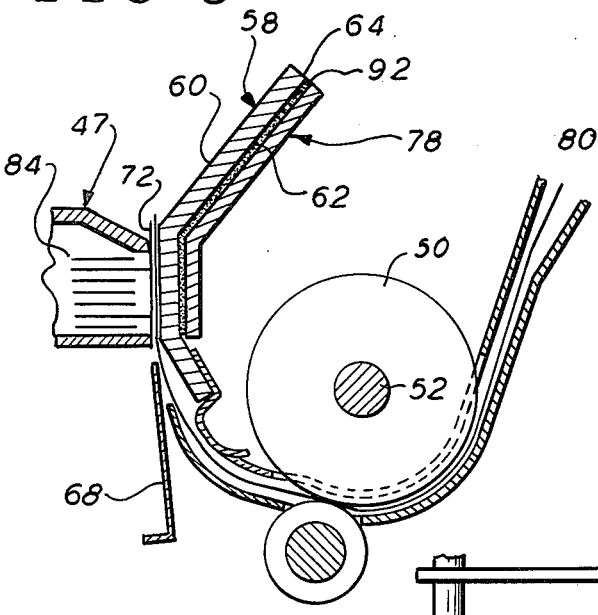
FIG. 5 is a view taken substantially through line 5—5 of FIG. 1 showing the platen and an acoustic noise suppressor fastened thereto.

The component of noise generated by the impact of the dot wires 84 against the platen 58 during the process of printing a dot on the printer paper may be reduced by applying the teachings of this invention to a printer mechanism 32 such as that described hereinabove. FIG. 5 illustrates that the rear surface 62 of the platen 58 has fastened substantially along its entire length a means for attenuating acoustical noise 78 which is preferably formed from a strip of lead. The acoustical noise attenuating means 78 is shaped to be complemental to the shape of the platen 58, and extends along the length of the platen 58 from the intersection of the platen 58 with the sidewall 44 to the intersection of the platen 58 with the sidewall 46 so that each location along the platen 58 at which a print element 48 may cause a dot wire 84 to strike the printer paper has therebehind the means for attenuating acoustical noise 78. The means for attenuating acoustical noise 78 may be fastened to the platen 58 in any convenient manner, as for example by a continuous cement or thermoplastic compound 92 between the rear surface 62 of the platen 58 and the attenuating means 78.

When the printer mechanism 32 operates to print characters on the printer paper during the operation of the calculator or other machine having a printer therein, the printer head 47 is moved across the width of the printer paper. Electrical signals are selectively supplied to the print elements 48 to produce a pattern of dots across the width of the paper by driving the dot wires 84 against the ribbon 72. The means for attenuating acoustical noise 78 absorbs and uniformly reduces the retransmission of noise generated by the impact of the dot wires 84 against the platen 58 along the entire length of the platen 58. The continuous coverage along the length of the platen 58 by the means for attenuating acoustical noise 78 insure that a minimal quantity of noise is reradiated from the platen 58.

What has been described is a novel means for attenuating acoustical noise generated in a printer mechanism so that the operator and others are not disturbed during the operation of the mechanism. Numerous alterations of the structure herein disclosed will suggest themselves to those skilled in the art in light of the above teachings. For example the printing means need not be moved longitudinally along the platen, but may consist of a plurality of printer heads fixed across the width of the printer paper. However, it is to be understood that the present disclosure relates to a preferred embodiment which, for the purpose of illustration only has been shown applied to a calculator mechanism and should not be construed as a limitation of the invention. All modifications which do not depart from the spirit of the invention are intended to be included within the scope of the appended claims.

I claim:

1. In a printer mechanism adapted to receive a quantity of printer paper adapted to have indicia printed thereon;

printing means in said printing mechanism selectively operable for printing indicia on the printer paper by impact against the printer paper;

a platen for supporting the printer paper against the impact of said printing means, said platen having a front surface facing said printing means and a rear surface behind said front surface;

the improvement comprising: means comprised substantially of lead for attenuating acoustical noise fastened to said platen with a thermoplastic compound and extending continously along the length of the rear surface of said platen, whereby acoustical noise generated by the impact of said printing means against the printer paper supported by said platen is attenuated.

2. The arrangement set forth in claim 1 wherein said printing means includes at least one print element, and at least one solenoid, said at least one print element being driven toward said printer paper by selectively energizing said at least one solenoid.

3. The arrangement set forth in claim 1 wherein said printer mechanism includes means for moving the printer paper in front of said printing means, comprising a roller, said roller frictionally engaging said printer paper.

4. The arrangement set forth in claim 1 wherein said platen includes an upper portion integral therewith, said upper portion sloping upward and away from said printing means.

5. The arrangement as set forth in claim 1 wherein said means for attenuating acoustical noise is fastened by a continuous bond along the length of the rear surface of said platen.

* * * * *